US006789497B1

(12) United States Patent
Aiken

(10) Patent No.: US 6,789,497 B1
(45) Date of Patent: Sep. 14, 2004

(54) INDICATOR FOR PILL BOTTLE

(76) Inventor: Edwin H. Aiken, 1228 Brighton Ave., Arroyo Grande, CA (US) 93420

( * ) Notice: Subject to any disclaimer, the term of this patent is extended or adjusted under 35 U.S.C. 154(b) by 0 days.

(21) Appl. No.: 10/408,821

(22) Filed: Apr. 8, 2003

(51) Int. Cl.[7] ..... G09F 9/40
(52) U.S. Cl. ..... 116/308; 116/315; 116/316
(58) Field of Search ..... 116/308, 309, 116/311, 312, 313, 314, 315, 316, 317, 318, 319, 320; 206/459.1; 215/230

(56) References Cited

U.S. PATENT DOCUMENTS 332,208 A * 12/1885 Noel ..... 116/308
4,041,628 A * 8/1977 Sasson ..... 40/111
4,347,804 A * 9/1982 Villa-Real ..... 116/308
4,365,722 A * 12/1982 Kramer ..... 215/220
4,405,045 A * 9/1983 Villa-Real ..... 206/534
4,432,300 A * 2/1984 Lyss ..... 116/308
4,489,834 A * 12/1984 Thackrey ..... 206/534
4,501,370 A * 2/1985 Kelley ..... 215/219
4,528,933 A * 7/1985 Allen ..... 116/308
4,579,224 A * 4/1986 Heavener ..... 206/315.1
4,662,520 A * 5/1987 Griffin ..... 206/459.1
4,753,189 A * 6/1988 Mastman et al. ..... 116/308
4,756,423 A * 7/1988 Holtsch ..... 206/534
4,915,256 A * 4/1990 Tump ..... 221/5
5,216,975 A * 6/1993 Bartholomew ..... 116/324
5,279,422 A * 1/1994 Adams ..... 206/534
5,975,010 A * 11/1999 Marshall ..... 116/315
2003/0000452 A1 * 1/2003 Zamjahn ..... 116/315

* cited by examiner

*Primary Examiner*—Christopher W. Fulton
*Assistant Examiner*—R. Alexander Smith
(74) *Attorney, Agent, or Firm*—George L. Williamson

(57) ABSTRACT

The present invention discloses an indicator or numbering device for keeping track of the number of vitamins/medicine pills that one has taken. The present invention comprises a circular cover disk having a circular base plate disposed therein which plate is attached to the top of a medicine bottle, along with an indicator disposed between the cover disk and the base plate whereby the cover disk has an aperture therein which permits viewing of the days of the week which are stamped onto the top of the circular base plate. The indicator operates rotatably between the cover disk and the base plate to indicate the number of medications taken on a given day. The present invention may utilize a two-sided, adhesive strip for attachment of the circular base plate to the top of a medicine bottle.

11 Claims, 5 Drawing Sheets

INDICATOR FOR PILL BOTTLE

BACKGROUND OF THE INVENTION

1. Field of the Invention

The present invention generally relates to bottle tops, and, more particularly, is concerned with an indicator to be placed on pill bottle tops which shows the number of pills that are to be taken on a given day.

2. Description of the Prior Art

Indicators have been described in the prior art. However, none of the prior art devices disclose the unique features of the present.

In U.S. Pat. No. 5,975,010, dated Nov. 2, 1999, Marshall disclosed indicators and methods of indicating which are intended primarily for use with medicine containers. The devices typically indicate the number of doses of medication ingested or remaining to be taken by a patient during a particular period. These devices additionally provide tactile assistance to patients in appropriately repositioning the indicator arms and, when used correctly, may reduce the possibility of patient overdose by restricting improper attempts to advance the indicator arm.

In U.S. Pat. No. 4,579,224, dated Apr. 1, 1986, Heavener disclosed a container for game board pieces and other equipment, such as dice and cards, which has a carrying and storing handle, and is provided with a partially open area on one side thereof. A flat member is fastened by hinges to the container and folds forward to at least partially close the open area of the container. There is enough space between this hinged flat member and the container so that the game board will fit between these two parts. The game board is held in place as a result of pins extending from the container through the game board and making frictional engagement with the holes in the flat, hinged member. The flat, hinged member may alternatively be held in assembly with the game board by straps, and either the pins or straps may be employed to hold the flat, hinged member over the open area of the container when it is desired to store the game pieces without securing the container to the game board. The handle may have a slight central recess for convenience in mounting a number of the units on a pegboard or the like.

In U.S. Pat. No. 4,489,834, dated Dec. 25, 1984, Thackrey disclosed a medicine bottle and cap, the cap containing a window through which one of several index marks, preferably serial numbers, is visible. The index marks are on a member nesting inside the cap and equipped with spring fingers set at an angle on a skirt. During opening of the bottle, this marked member is prevented from rotating as the cap is unscrewed, thus indexing the index marks. During closing, frictional forces cause all parts to rotate together.

In U.S. Pat. No. 4,753,189, dated Jun. 28, 1988, Mastman, et al, disclosed a medicine bottle unit having a closure for indicating dosage and other information which changes automatically as the closure is rotated on the bottle of the unit. The closure includes an outer cap and an inner member within the cap. The cap and inner member have cooperable indicia thereon. The inner member moves with the cap as the cap is rotated in one direction on the bottle. However, the cap moves relative to the bottle and the inner member when the cap is rotated in the opposite direction on the bottle, thus assuring a change in the information represented by the indicia on the cap and the indicator on the inner member, or by indicia on the inner member visible through a hole in the cap. Several embodiments of medicine bottle unit are disclosed.

In U.S. Pat. No. 4,432,300, dated Feb. 21, 1984, Lyss disclosed a pill dispenser having a rotatable cap with special opening means for dispensing a pill at the proper time for medication. The dispenser comprises a housing having openings corresponding to each time for medication in a repetitive cycle such as in a day or week. A rotatable indicator cap or lid has means cooperating with the housing to provide by a detent means stagewise movement and in a modification ratchet means for one way rotation. An opening in the cap is provided for view of indicia means on the top of the housing with a selected time for taking indicia. When the time for taking the pill arrives, the cap is rotated to present a dispensing opening in registry with one of the housing openings for dispensing a pill. The indicator cap and a bottom fill cap may be press fitted on the bottle housing for simple fabrication and refilling the contents.

In U.S. Pat. No. 4,528,933, dated Jul. 16, 1985, Allen disclosed a container for pharmaceuticals and the like which has a caplike closure incorporating an indicator disk which is automatically indexed into successive indicating positions each time the container is used by removal and replacement of the closure. The container also has a manually operable rotary reminder wheel on its base. The disk may be used to indicate days of the week and the wheel to indicate hours of the day.

In U.S. Pat. No. 4,405,045, dated Sep. 20, 1983, Villa-Real disclosed a color-coded, two-component medicament container comprising a cap means with variously pre-set structural interval spacings between each pair of preformed window system to differentiate a fixed three-hour time interval cap from a four-hour interval cap, a six-hour time interval cap, an 8-hour time interval cap and from a unitary pre-formed window for a 12 or 24-hour time interval cap; each kind of cap to be specifically used according to the prescribed frequency of drug administration such as every 3-hour frequency, every 4-hour frequency, every 6-hour frequency, every 8-hour frequency and every 12 or 24-hour frequency, respectively, as coordinated in a snug-fitting but clockwisely rotatable engagement with a complementarily shaped cylindrical medicament container having clock-like numeral indicia ranging from 1 to 12 and equidistantly arranged as in a clock therearound the supper circumferential exterior wall of the said indicament container is disclosed.

In U.S. Pat. No. 4,347,804, dated Sep. 7, 1982, Villa-Real disclosed a simple mechanically manipulatable two-component interacting device for use as an effective medication time intake reminder having a stationary outer ring component having a circularly running clocklike numerical indicia that are equally interspaced between each succeeding numeral ranging from 1 to 12 is disclosed. The inner rotatory disc has fixed interval spacings between the "LAST DOSE" arrow indicia and the "NEXT DOSE" arrow indicia depending upon the required application such as the time interval called for in the administration of each particular medication. It is also disclosed and preferred that each rotatory disc for each respective time interval application be differently color coded to easily distinguish one from the other.

In U.S. Pat. No. 4,915,256, dated Apr. 10, 1990, Tump disclosed a dispenser for dispensing a series of different pills over a prescribed period. The dispenser is provided with an indicator that is adjustable to preset the start of the pill regiment on whatever day desired. The pill package and dispenser are constructed and arranged so that after the indicator has been preset, the pill package can be fixedly positioned in the dispenser with the first pill of the regimen in position to be taken by the user on the first preselected day.

In U.S. Pat. No. 5,279,422, dated Jan. 18, 1994, Adams disclosed a device suitable as a closure cap for a medicine container. The device has indicia circumferentially marked on the upper surface of the device representing the time for next taking the medicine in the container. An arm rotatably and pivotably mounted in the center of the device is set to point at the time for next taking the medicine. The arm is releasably retained in position by cooperating pegs and indentations on the upper surface of the device and the underside of the rotatable arm.

In U.S. Pat. No. 5,216,975, dated Jun. 8, 1993, Bartholomew disclosed a combination pill bottle cap and indicator device adapted to function as the closure or cover for a pill bottle or container. The device includes an indicator providing a visual indication for the user that a pill has been or should be removed from the bottle for consumption.

In U.S. Pat. No. 4,501,370, dated Feb. 26, 1985, Kelley disclosed a top for a pill or other medicine bottle having an externally threaded upper portion which receives the top. The top includes a cover which defines a recess having an internally threaded section for receiving the externally threaded portion of the bottle. The cover is proportioned for closing the upper portion of the bottle. Indicia in the form of numbers from one to twelve in the preferred embodiment are carried by the cover. A dial member rotatable mounted on the cover is moved by the user to indicate the time when the next dosage of medicine contained in the bottle is to be taken. In another embodiment, means are provided to be taken. In another embodiment means are provided to child-proof the top such that the children cannot inadvertently gain access to the bottle contents.

While these indicators may be suitable for the purposes for which they were designed, they would not be as suitable for the purposes of the present invention, as hereinafter described.

SUMMARY OF THE INVENTION

The present invention discloses an indicator or numbering device for keeping track of the number of vitamins/medicine pills that one has taken. The present invention comprises a circular cover disk having a circular base plate disposed therein which plate is attached to the top of a medicine bottle, along with an indicator rotatably contained between the cover disk and the base plate whereby the cover disk has an aperture therein which permits viewing of the days of the week which are stamped onto the top of the circular base plate. The indicator operates rotatably between the cover disk and the base plate to indicate the number of medications taken on a given day. The present invention may utilize a two-sided, adhesive strip for attachment of the circular base plate to the top of a medicine bottle.

An object of the present invention is to provide a simple means of keeping track of the number of pills of medication/vitamins taken from a given bottle on a given day. A further object of the present invention is to provide a simple means of attachment of an indicator to a conventional bottle top.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is defined by the pending claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
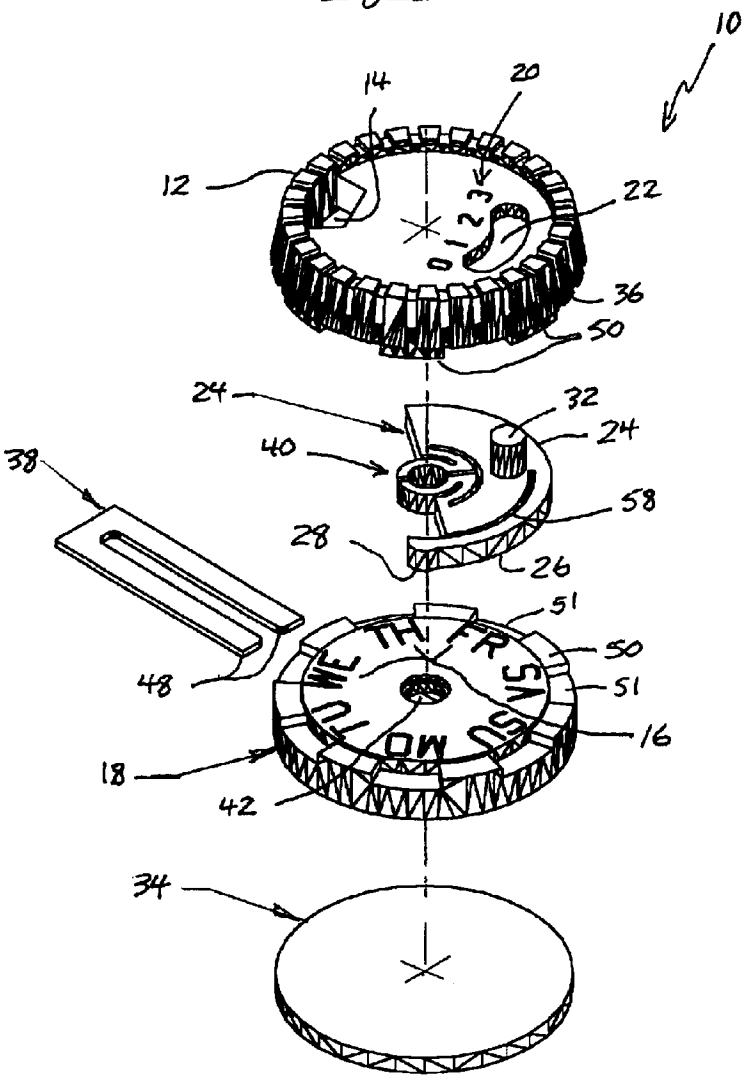
FIG. 1 is an exploded view taken from the top of the present invention.

With regard to reference numerals used, the following numbering is used throughout the drawings.

10 present invention
12 cover disk
14 aperture
16 days of week indicia
18 base plate
20 number of pills indicia
22 curved aperture
24 indicator
26 curved arm
28 protrusion
30 indentions
32 shaft
34 adhesive
36 edge of cover disk
38 clip
40 central aperture
42 central aperture
44 stem
46 recess
48 arms of clip
50 mating lugs
51 depression
52 top surfaces
54 top
56 container
58 cut out
60 groove

DESCRIPTION OF THE PREFERRED EMBODIMENT(S)

In order that the invention may be more fully understood, it will now be described, by way of example, with reference to the accompanying drawings which illustrate the present invention wherein an indicator for attachment to a conventional medicine bottle is disclosed.

Figure 2:
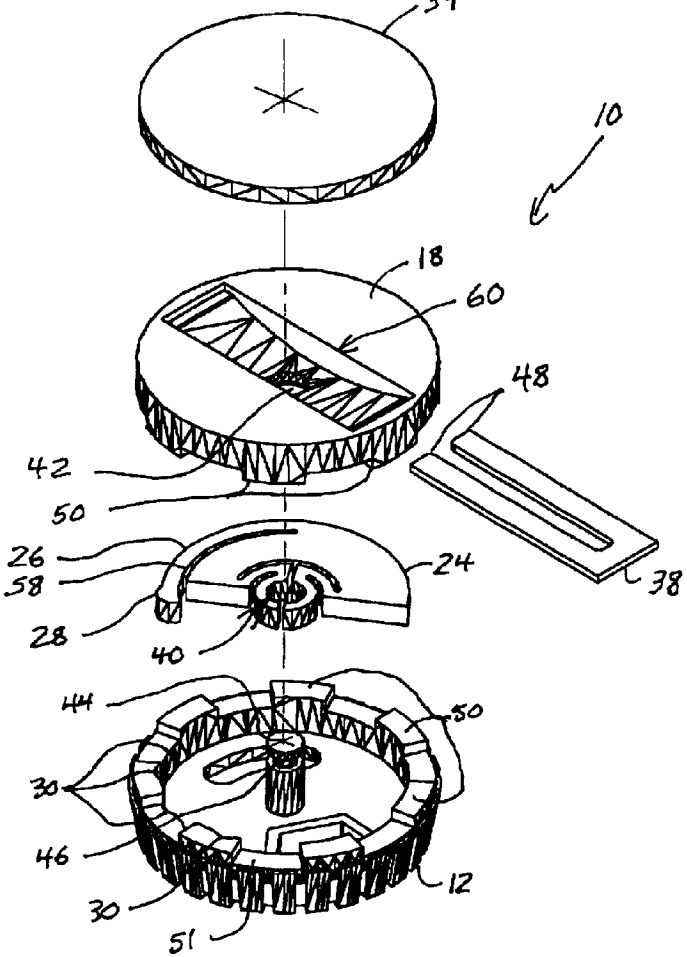
FIG. 2 is an exploded view taken from the bottom of the present invention.

Turning to FIGS. 1 and 2, shown therein is the present invention 10 having a circular cover disk 12 having an aperture or slot 14 disposed therein through which slot 14 the indicia for the days of the week 16 disposed on base plate 18 can be observed. Additionally, indicia or numerals 20 (shown as 0, 1, 2 and 3) are disposed into the upper surface of the cover disk 12 along the length of the kidney bean-shaped curved aperture or slot 22 to indicate the number of pills taken on a given day. Cover disk 12 also has a downwardly extending peripheral edge 36 which forms a recess therein for receiving the indicator 24 and top of the base plate 18. Also shown therein is the circular base plate 18 of the present invention having the days of the week 16 abbreviated thereon by being embossed on the topside of the circular base plate 18 being spaced apart about the topside of the circular base plate 18 in a radical direction. Also shown therein is the indicator 24 having a cut out 58 and a flexible curved arm 26 having a radially disposed protrusion 28 disposed on its end so that the protrusion 28 of the indicator arm 26 extends into one of four indentions 30 disposed on the bottom inside of the cover disk 12 so as to position the indicator shaft 32 in the proper position to extend upwardly through aperture 22 to indicate the number of pills by placement of shaft 32 adjacent the corresponding indicia 20. Also shown therein is a clip 38 which slides into groove 60 on the back of base plate 18 and the double-sided adhesive tape or the like 34 which is used to attach the present invention 10 to be planer top of a conventional pill bottle.

It can be seen that indicator 24 has a centrally disposed aperture 40 and that the base plate 18 has a centrally disposed aperture 42. Both apertures 40 and 42 are coaligned for receiving stem 44 therethrough from the bottom side of the cover disk 12. Note that stem 44 has a recess 46 adjacent its end which recess receives the opposing arms 48 of the leaf spring or clip 38. When leaf spring or clip arms 48 are inserted through the recess 46 of stem 44, the base plate and indicator 24 are captured therein between the cover disk 12 and spring or clip 38 so as to form a completed assembly. The adhesive disk 34 is the then placed on the bottom side of base plate 18 and then placed onto a top of a conventional pill bottle to form a completed assembly which is shown in operative connection in FIG. 3. The indicator 24 slides pivotally around the stem 44 disposed in the center of the cover disk 12. The flexible curved arm 26 of the indicator 24 rests in one of four indentations 30 in the inner surface of the circular wall or edge 36 of the cover disc 12. The stub shaft 32 on the indicator 24 protrudes through the "kidney bean" shaped hole 22 in the cover disk 12. The four indentions 30 are positioned so that the stub shaft 32 is movably fixed or retarded at each of the four positions 20 (0 to 3) engraved in the topside of the cover disc 12. The four positions 20 (0 to 3) assume that a user would be taking up to three medications per day. If desired, this can be increased to six with very little difficulty.

After insertion of the indicator 24 onto the cover disc 12 the base plate 18 then fits onto the cover disc stem 44. It is secured by deflecting the arms 48 away from each other and sliding the leaf spring or clip 38 into the annular groove or recess 46 on the stem 44 or by otherwise placing the clip 38 into recess 46. The end of the stem 44 is of an effective length so that it will not contact the two-sided adhesive disk 34 (if utilized) which may be used to attach the assembly to the container lid. The top surface of the base plate 18 is engraved with the seven days of the week 16 that can be seen through an additional hole 14 in the cover disk 14 opposite the "kidney bean" shaped hole 22. The cover disc 12 is serrated around the outside surface 36 to permit easy gripping during the day-setting changes. To change the day of the week, the user lifts the cover disk 12 upwardly about 0.05 to about 0.06 inches and rotates it to the desired day; this upward movement of the cover disk 12 is allowed by the flexibility of the leaf spring or clip 38 as it flexes upwardly an effective distance to allow rotation of the cover disk 12. There are seven sets of mating lugs 50 and corresponding depression 51 thereinbetween on both the cover disk 12 and the base plate 18 that lock the two parts together until the cover disk 12 is intentionally lifted and rotated. The act of opening a container lid usually results with the user pushing down while twisting the lid rather than pulling up on it so it is not too probable that he/she would inadvertently change the day of the week setting while opening the container.

Figure 3:
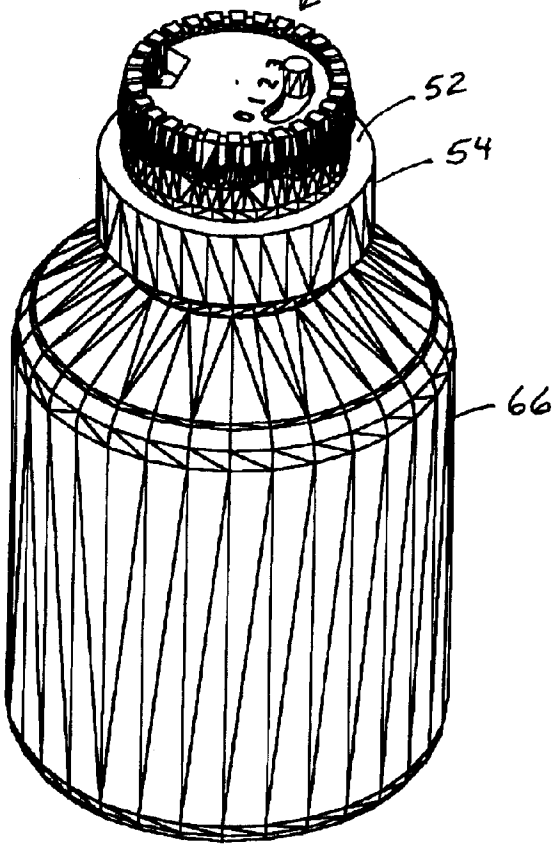
FIG. 3 is a perspective view of the present invention shown in operative connection.

Turning to FIG. 3, therein is shown a perspective view of the present invention 10 attached to the planar top surface 52 of the top 54 of a conventional medicine container or bottle 56 which cap 54 is normally secured to container 56.

Figure 4:
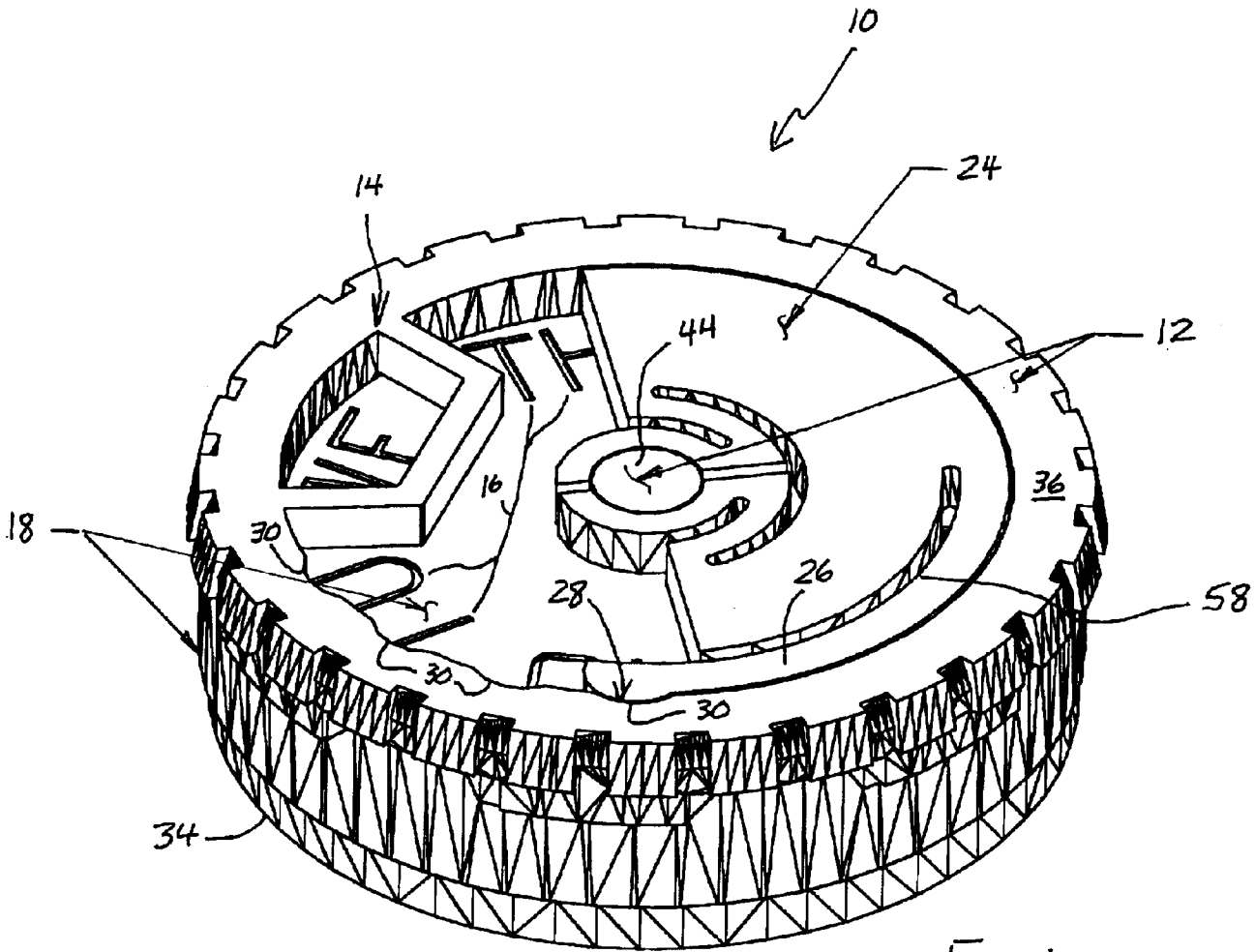
FIG. 4 is a cross-section view of the present invention.

Turning to FIG. 4, therein is shown a cross-sectional view of the present invention 10 showing the cover disk 12, the indicator 24, the base plate 18 and adhesive disk 34. As a part of the cover disk 12, shown is the aperture 14 through which the days of the week 16 shown on the top surface of the base plate 18 can be observed. The indicator 24 has arm 26 with its protrusion 28 thereon disposed by means of its central aperture 40 onto the stem 44 of the cover disk 12. Protrusion 28 is shown disposed in one indication 30 on the inside of the downwardly extending edge 36 of the cover disk 12. The curved cut out 58 provides sufficient flexibility for the curved arm 26 to engage and disengage the indentations 30 in cover disk 12.

Figure 5:
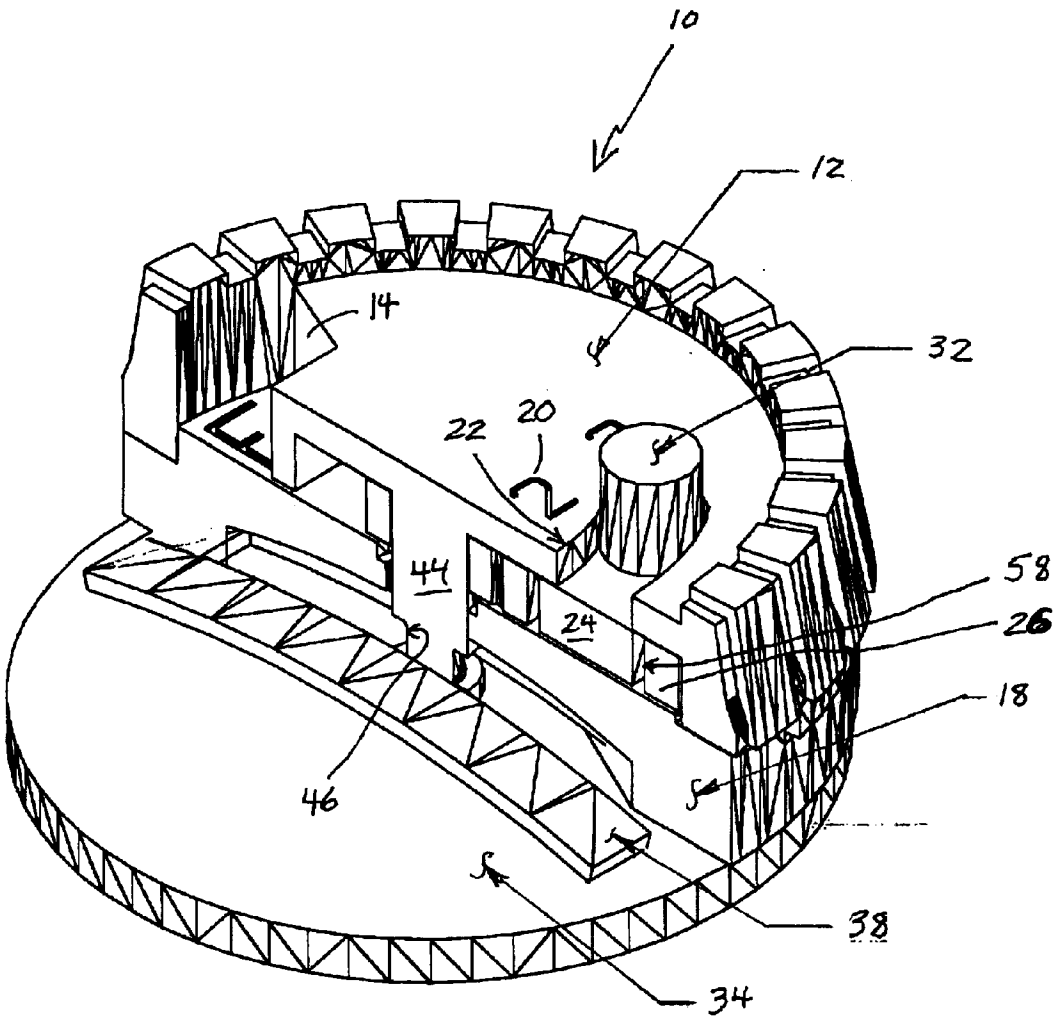
FIG. 5 is a cross-section view of the present invention.

Turning to FIG. 5, therein is shown a cross-sectional view of the present invention 10 showing the cover disk 12, the indicator shaft 32, the base plate 18, leaf spring 38 and adhesive disk 34. Also shown on the cover disk is aperture 14, the indicia 20 showing the number of doses, pills or medications, along with the kidney-shaped aperture 22 with the indicator shaft 32 protruding therethrough also showing the indicator 24 with curved arm 26 and cut out 58. The arms of the leaf spring or clip 38 are shown disposed inside the recess 46 of stem 44 and capturing the stem which extends downwardly from cover disk 12.

Figure 6:
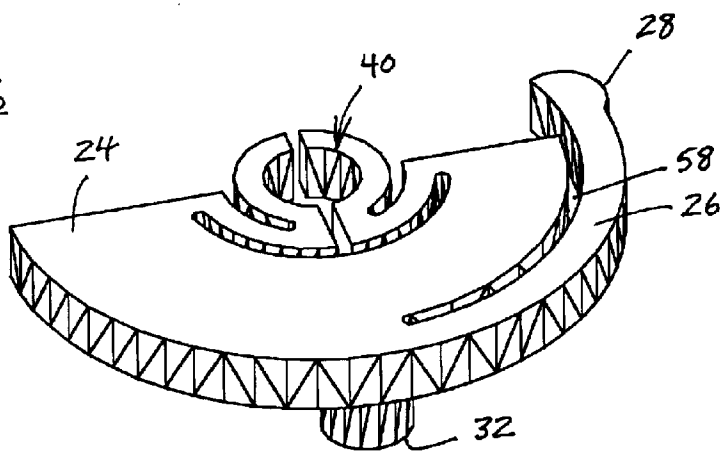
FIG. 6 is a bottom perspective view of part of the present invention

Turning to FIG. 6, therein is shown an indicator 24 along with its shaft 32, arm 26, cut out 58, protrusion 28 and its central aperture 40.

Figure 7:
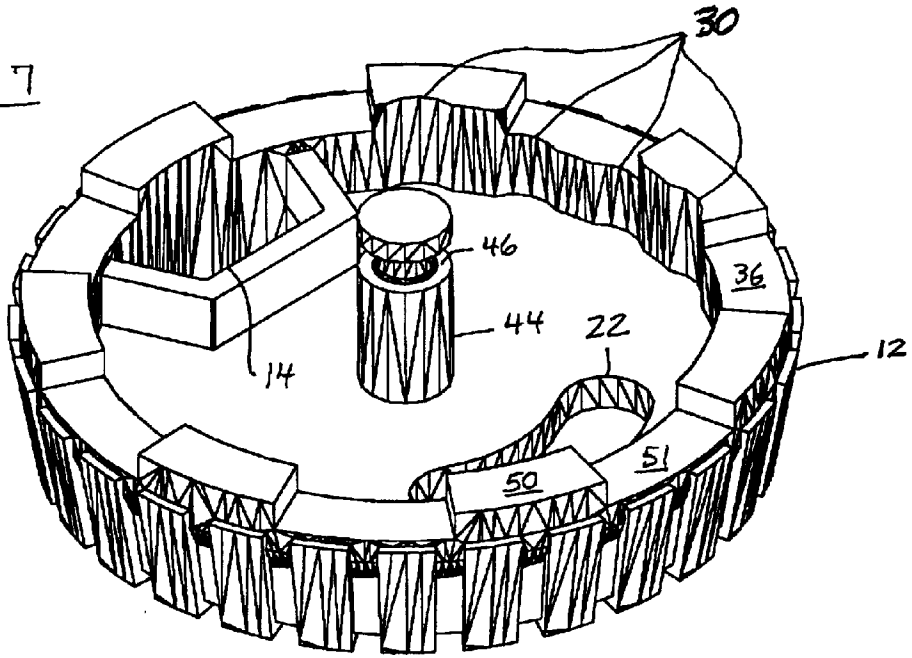
FIG. 7 is a bottom perspective view of part of the present invention.

Turning to FIG. 7, therein is shown the cover disk 12 with its four indentions 30 along with its stem 44 with recess 46, aperture 14, kidney bean-shaped aperture 22 and its downwardly extending sides 36 having lugs 50 thereon. Lugs 50 prevent inadvertent rotation of the cover disk 12.

I claim:

1. An apparatus for indicating the number of medications taken from a medicine container, comprising:

a) a medicine container having a top thereon, said top having a substantially planar surface for attachment of the apparatus thereto;

b) a cover disk having a top and bottom surface, a downwardly extending edge disposed circumferentially around said cover disk, said edge having a top, bottom and inner surface, said cover disk having a first and second aperture therein, wherein said first and second aperture are generally disposed on opposite sides of said cover disk and said first and second apertures pass completely through said cover disk from said top surface to said bottom surface of said cover disk, further comprising first indicia disposed on said top surface of said cover disk adjacent said second aperture, said first indicia comprising numerals 0, 1, 2 and 3 corresponding to the number of medications take during one day, further comprising a plurality of equally spaced apart lugs being downwardly disposed around said bottom of said edge of said cover disk, further comprising a downwardly extending stem being centrally disposed on said bottom of said cover disk, wherein said distal end of said stem has a recess disposed proximate to said distal end, further comprising at least four indentions disposed in a spaced apart manner on said inner surface of said edge;

c) an indicator rotatably disposed adjacent said bottom of said cover disk, said indicator having a top and bottom surface, said indicator being a substantially semi-circular shaped disk having a vertically disposed aperture therein, wherein said aperture is disposed substantially intermediate of the edge corresponding to the would be diameter of said semi-circular shape, wherein said aperture of said indicator receives said downwardly extending stem of said cover disk therein, wherein said indicator is rotatably disposed on said stem, further comprising a shaft being disposed on said top surface of said indicator, said shaft passing upwardly through said second aperture of said cover disk to indicate the number of medications taken, further comprising a curved arm formed along said periphery of said indicator, said current arm having an outwardly extending protrusion on the end of said curved arm, wherein said protrusion rests in one of said four indentions as said indicator rotates about said stem, wherein said four depressions correspond to said first indicia, wherein said protrusion rests in said indention corresponding to the number of medications taken as indicated by said first indicia being located adjacent to said shaft, wherein said adjacency of said first indicia and said shaft are visible on said top of said cover disk;

d) a base plate having a top and bottom surface, said top of said base place being disposed adjacent to said bottom of said indicator, said base plate being disk-shaped, wherein second indicia are spaced apart equally around the edge of said top surface of said disk, said second indicia indicating the days to the week, said days being indicated in order of occurrence, wherein said base plate has a centrally disposed aperture therein, wherein said aperture rotatably receives said stem of said cover disk, said base plate being rotatable on said stem, wherein said second indicia align with and are visible through said first aperture in said cover disk to permit a user to see the day of the week, wherein said bottom surface of said base plate has a groove therein, said groove being disposed so as to encompass said centrally disposed aperture and to contain said recess on said end of said stem, wherein a plurality of lug receiving depressions are equally spaced apart around the periphery of said top edge of said base plate, wherein said depressions correspond to and receive said lugs disposed on said bottom of said edge of said cover disk to permit a user to change the indicated day of week by rotating said cover disk around said base plate;

c) a spring clip, wherein said clip is U-shaped having a pair of flexible, parallel arms, wherein said clip is disposed in said groove, wherein said arms of said clip are slidingly disposed in said recess of said stem so that said cover disk, said indicator and said base plate are removably secured together to permit a user to change the indicated day of week by lifting the cover disk and rotating the cover disk around the base plate and then releasing the cover disk when the appropriate day of week is visible through the first aperture of the cover disk; and, f) an adhesive member for attaching said bottom of said base plate to said top of said medicine container.

2. The apparatus of claim 1, wherein said top of said edge of said cover disk is knurled to permit a user to grasp the cover disk.

3. The apparatus of claim 2, wherein said clip is effectively flexible to allow said cover disk to be lifted and rotated to permit the lugs on the bottom of the edge of the cover disk to freely rotate above the depressions in the edge of the base plate.

4. The apparatus of claim 3, wherein said indicator has a cut out therein, said cut out being disposed between said curved arm and said indicator, said cut out being of effective size so that said curved arm can be movably fixed in said indentions on said cover disk to permit a user to indicate the number of medications taken per day.

5. The apparatus of claim 4, wherein said arms of said spring clip are spaced apart a distance equal to the diameter of said recess of said stem and less than the diameter of said stem so that said stem is movably fixed within said arms to permit the cover disk, the indicator and the base plate to be rotatably held together.

6. The apparatus of claim 5, wherein said indentations number four to permit the apparatus to indicate up to three medications taken per day.

7. The apparatus of claim 1, wherein said indentions number six to permit the apparatus to indicate up to five medications taken per day.

8. The apparatus of claim 7, wherein said first indicia number 0 to 5 to permit the apparatus to indicate up to five medications taken per day.

9. The apparatus of claim 8, wherein said lugs and said depressions are seven in number to correspond to the seven days of the week.

10. The apparatus of claim 9, wherein said clip flexes about 0.05 to 0.06 inches to allow said cover disk to be lifted and rotated to permit the lugs on the bottom of the edge of the cover disk to freely rotate above the depressions in the edge of the base plate.

11. An apparatus for indicating the number of medications taken from a medicine container, comprising:

a) a medicine container having a top thereon, said top having a substantially planar surface for attachment of the apparatus thereto;

b) a cover disk having a top and bottom surface, a downwardly extending edge disposed circumferentially around said cover disk, said edge having a top, a bottom and inner surface, said cover disk having a first and second aperture therein, wherein said first and second aperture are generally disposed on opposite sides of said cover disk and said first and second apertures pass completely through said cover disk from said top surface to said bottom surface of said cover disk, further comprising first indicia disposed on said top surface of said cover disk adjacent said second aperture, said first indicia comprising numerals 0, 1, 2 and 3 corresponding to the number of medications take during one day;

c) for a second member rotatably disposed underneath said cover disk whereby the number of medications taken per day is indicated through the second aperture on the cover disk;

d) a third member rotatably disposed underneath said second member whereby the day of the week is indicated through the first aperture of the cover disk;

e) means for securing together said cover disk, said second member and said third member whereby the apparatus is movably fixed together; and, f) means for attaching the apparatus to the top of the medicine container whereby the apparatus is removably fixed to the medicine container.

* * * * *